United States Patent [19]

Spaunhorst

[11] Patent Number: 4,751,489

[45] Date of Patent: Jun. 14, 1988

[54] SUBMINIATURE FUSES

[75] Inventor: Vernon Spaunhorst, Washington, Mo.

[73] Assignee: Cooper Industries, Inc., Houston, Tex.

[21] Appl. No.: 897,689

[22] Filed: Aug. 18, 1986

[51] Int. Cl.[4] ..... H01H 85/16

[52] U.S. Cl. ..... 337/260; 337/255; 337/263

[58] Field of Search ..... 337/255, 260, 262, 261, 337/186, 216, 208; 29/263

[56] References Cited

U.S. PATENT DOCUMENTS 3,110,787 11/1963 Borzoni ..... 337/260

*Primary Examiner*—Harold Broome

*Attorney, Agent, or Firm*—Eddie E. Scott; Nelson A. Blish; Alan R. Thiele

[57] ABSTRACT

A subminiature fuse comprising two terminals, a substrate, a fusible conductor, ceramic coating, a second coating and a unitary housing. A ceramic substrate 80 plated at both ends is inserted into fingers (70) in terminal, a fusible wire element 10 is strung between the fingers (70) and (20, 30) and electrically connects the terminal (20, 30). The assembly 160 is encased in a ceramic adhesive 180 which is encased in a second material (200) with superior dielectric properties. The ceramic encased assembly is enclosed in a unitary housing by injection molding.

7 Claims, 2 Drawing Sheets

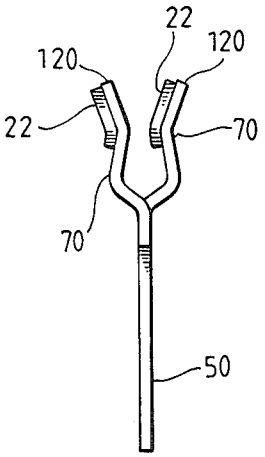
Fig. 4
Fig. 6
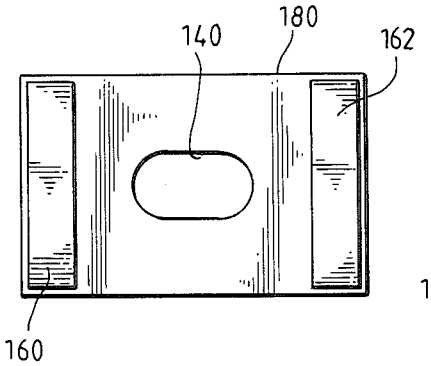
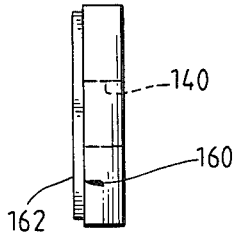
Fig. 7
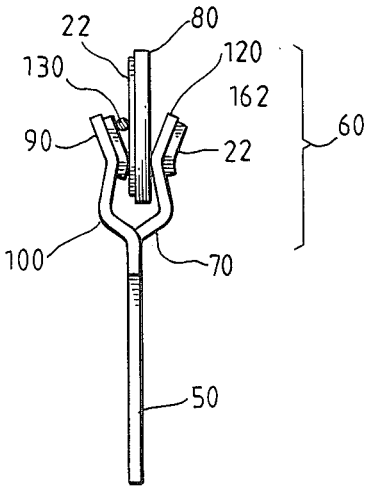
Fig. 5
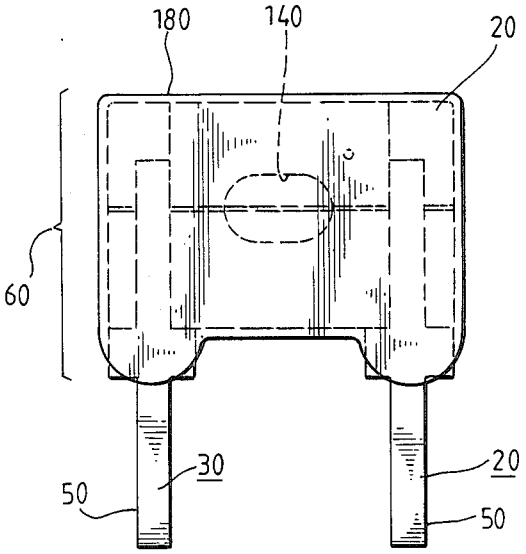
Fig. 8

SUBMINIATURE FUSES

TECHNICAL FIELD

This invention relates to fuses in general and more particularly to a subminiature electrical fuse of the type used for electrical circuit protection in applications where there is a limited amount of space as is described in co-pending applications, U.S. Ser. Nos. 715,799 and 852,605. This type of fuse is especially useful for saving space on printed circuit boards.

BACKGROUND OF THE INVENTION

Subminiature fuses, like other types of fuses are used to protect circuit components from damage that can be caused by excess current flowing through the circuit. Excess current is generally categorized as either an overload current or a short circuit current. Overload current is generally considered to be in the range of 135% to 500% of normal or rated current. Short circuit current may be above 500% of rated current.

To be certified by Underwriters' Laboratory, a fuse must pass certain test requirements such as a short circuit test, a low overload test and a continuity test. For the low overload test, the fuse element must open within a specified period of time at a percentage of the rated current ranging anywhere from 135–500%. For the short circuit test, the fuse element must open the circuit without rupture of the fuse body. For the continuity test, after the fuse has opened, the voltage is held for one minute during which time the fuse must not restrike.

Many conventional fuses are constructed from a fuse element and a two piece fuse housing comprising a cap and a base. During a short circuit condition, pressure inside the housing increases. Due to the small physical size of the subminiature fuse and hence the short arc clearing gap, that is the short distance between the terminals carrying the fuse element, the housing for such a fuse is subject to catastrophic failure problems that are not normally inherent in a physically larger fuse. There is a risk that the fuse housing will blow apart or rupture.

In the two piece housing design, this rupture normally occurs at the seal between the cap and the base. If the housing ruptures, this would not only expose a live arc but would also prolong that arc thereby potentially causing damage to circuit components downstream of the fuse due to the additional time required to fully interrupt the circuit. Once the housing begins to leak, the pressure in the housing begins to decrease. This causes the interruption time to increase.

Those skilled in the art know that when the fuse element is subjected to short circuit current, the fuse element heats up until it reaches the melting point of the fuse element conductor. The rate of the heat build up is, among other things, a function of the magnitude of the excess current. Once the temperature of the conductor reaches its melting point, the conductor material is rapidly vaporized mixing vaporized metal atoms with the gas or air medium surrounding the conductor. An arc is formed in the gas mixture or plasma which acts as a conducting path for the arc. The increased temperature of the arc plasma also increases the pressure in the fuse housing. If the arc plasma becomes dense, the travel of the charged particles in the plasma is restricted. Decreased mobility of the charged particles increases the resistance of the gap, thereby acting to extinguish the arc which is necessary for the proper functioning of the fuse in interrupting current to the circuit. Thus it is seen that the increase in pressure in the fuse housing is beneficial in extinguishing the arc and interrupting current to the circuit. Prior art fuses have tended to rupture during increases in pressure.

An attempt to overcome this problem is illustrated in U.S. Ser. Nos. 715,799 and 852,605. These patent applications disclose a subminiature fuse comprising two terminals, a fusible element between the terminals supported on a ceramic substrate enclosed in a ceramic coating and surrounded by a unitary housing. While this fuse has been found to work well, a point is reached in the ampere rating where the fuse can no longer contain the pressures resulting from a short circuit. This is especially true for voltages of 250 volts or higher.

Therefore, it is an object of present invention to increase the short circuit performance of the subminiature fuse and thereby increase the maximum ampere rating attainable.

SUMMARY OF THE INVENTION

In accordance with the present invention, a subminiature electrical fuse for use primarily on circuit boards and other applications where physical space for electronic components is limited is disclosed. Fingers on terminal elements support a ceramic substrate. The substrate is metallized at both ends and is inserted into the fingers and support a fusible wire which electrically connects the two terminals. The fingers and the substrate form an assembly which is heated to solder the elements together with or without a flux. The assembly is encased in a ceramic adhesive material which is coated with a second material having a high dielectric strength, such as Boron Nitrate. The coated fuse body is enclosed in a unitary housing

BRIEF DESCRIPTION OF THE DRAWINGS

FIG. 4 is a side view of a terminal of the subminiature fuse shown in FIG. 1.

FIG. 5 is a side view of a terminal and substrate of the subminiature fuse shown in FIG. 1.

FIG. 6 is a plan view of a substrate used in the subminiature fuses shown in FIG. 1.

FIG. 7 is an end view of the substrate shown in FIG. 6.

FIG. 8 is a perspective view, partially in phantom of an assembly dipped in ceramic.

DETAILED DESCRIPTION OF THE INVENTION

Figure 1:
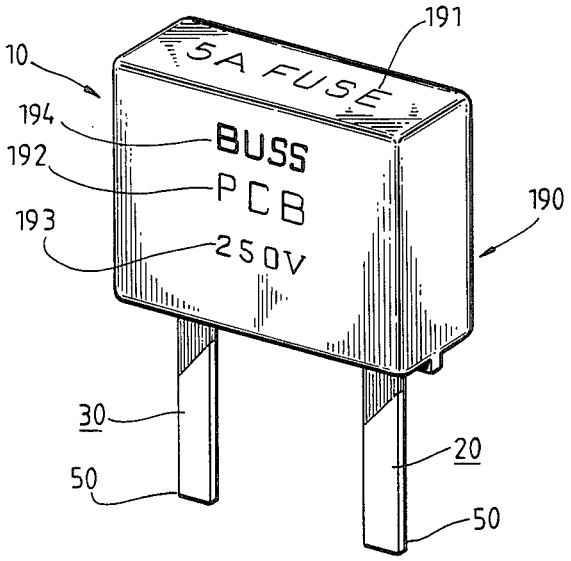
FIG. 1 is a perspective view of the subminiature fuse made in accordance with the method of the present invention.

While this invention is susceptible of embodiment in many different forms, there is shown in the drawings, which will herein be described in detail, several preferred embodiments of the invention. It should be understood however that the present disclosure is to be considered as an exemplification of the principles of the invention and is not intended to limit the invention to the specific embodiments illustrated.

Figure 3:
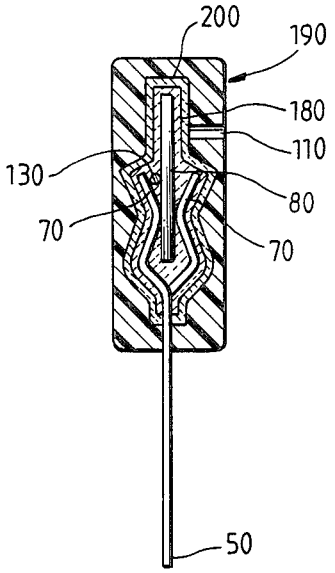
FIG. 3 is a sectional view from the side of the subminiature fuse shown in FIG. 1.
Figure 2:
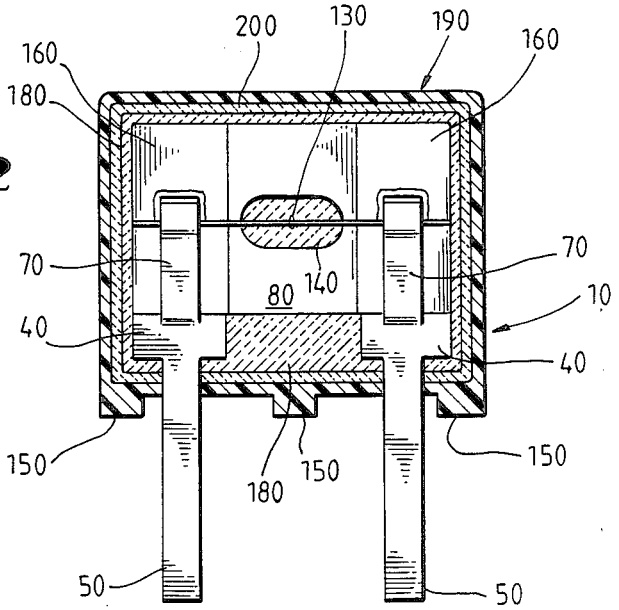
FIG. 2 is a sectional view of the subminiature fuse shown in FIG. 1.

Referring to the drawings, FIGS. 1-3 illustrate an embodiment of the subminiature fuse 10 that is the subject of the present invention. The fuse 10 comprises a first terminal 20, a second terminal 30, an insulating means or substrate 80, a fusible conductor 130, a ceramic coating 180, a second coating 200, and an enclosure 190. The amperage rating 191, the catalog symbol 192, the voltage rating 193, and the manufacture's trademark 194 serve to identify the particular fuse shown.

The two terminals 20 and 30 are each comprised of a top portion 40 and a bottom portion 50. The bottom portion 50 of the terminals 20 and 30 is adapted to plug into a printed circuit (PC) board where it is soldered in place or into a fuse receptacle located on a PC board, and is essentially flat. Although the flat configuration is preferred, the invention is equally adaptable to other configurations, such as use of a circular cross section conductive material.

The terminals 20 and 30 are made from copper alloy by stamping from a flat piece of conductor stock which may be plated with tin, solder, or any other suitable alloy. Other materials such as phospher-bronze and beryllium-bronze and other alloys of electrical conducting materials are also suitable. The tensile strength is preferably higher than the tensile strength of copper and lower than that of stainless steel.

The top portion 40 of terminals 20 and 30 may be coated with a tin solder 22 or tin lead composition so as to form a solder reflow joint. The preferred embodiment, shown in FIG. 4, shows tin or tin lead composition hot rolled onto one side prior to stamping the fingers 70. This process minimizes the amount of tin or tin lead composition by plating only one side of the flat conductor stock. The coated conductor material is said to be solder clad.

One, two, or more fingers 70 form an receptacle to receive the substrate 80. As shown in FIG. 5, each finger 70 is comprised of two curved portions 90 and 100 each forming an S-like configuration. The fingers 70 are joined at one end, with the curvatures 90 and 100 of each finger opposing each other. The overall configuration is fork-like and provides a spring compressive force at their closest points to mechanically hold substrate 80. The tip 120 of each finger 70 is disposed at an acute angle relative to substrate 80. This angle is made large enough to allow a fusible element 130 to fit between the tips 120 and the substrate 80. This will allow for the fusible element 130 to be drawn between the terminal finger 70 and the substrate 80 with minimal stress. Due to the fact that the fusible element 130 is a thin wire in the preferred embodiment with a very small diameter, it is necessary to reduce or eliminate any potential stress on the wire to prevent breaking.

The substrate 80 is used to mechanically link two of the top portions 40 into position. The substrate 80 shown in FIGS. 6 and 7 is flat and rectangular and is generally a box-like shape. The minimum length of the substrate between the terminals 20 and 30 is determined by the requisite spark gap to interrupt an arc generated by a predetermined system voltage and excess current. However the length may be increased to facilitate handling during the manufacturing process.

During the arc interruption cycle, the temperature in the fuse housing can reach temperatures above 400° F. Since the substrate is necessary to mechanically link the terminals 20 and 30 and to maintain the requisite spark gap distance, it is important that the substrate 80 not break down during the interruption cycle. Such breakdown of the substrate could cause catastrophic failure of the fuse. Also, it is important to use a material that will not carbonize at high temperatures, since it would support electrical conduction. For this reason, a material having the ability to withstand high temperature must be used. In the preferred embodiment, the substrate 80 is comprised of a ceramic polycrystalline material such as alumina silica oxide. However, various other ceramic polycrystalline materials such as glass, beryllia ceramic, mica and organic fiber are also suitable.

Another important consideration in selecting the substrate 80 is that it have good dielectric properties. Poor dielectric materials would allow conduction across the substrate 80 during interruption. This could result in an increased interruption time and therefore catastrophic failure of the fuse 10. Ceramic polycrystalline materials, as well as being good thermal insulators, have excellent electrical dielectric strength and are therefore suitable for use as a material for the substrates 80. The substrate 80 has one or more apertures 140 as discussed in more detail below.

Each end 160 of the substrate 80 is metallized 162 to form a connection means for the terminals 20 and 30 and the fusible conductor. In the preferred embodiment, the metallizing is done with silver or a silver alloy. In addition to being a good electrical conductor, it is desirable that the conductive material deposited on the substrate have a very high density and also be relatively easy to process. Since silver can be fired or sintered in air, unlike copper, which must be sintered in the presence of nitrogen, silver is preferred. Other conductor materials, such as gold, are equally suitable as conductor materials for the substrate. However, due to the cost factor, silver is preferred.

After the silver is deposited onto the substrate ends 160 and fired, the ends may be dipped into a tin or tin lead bath. This reduces oxidation and forms a solder reflow joint.

It is preferred that the solder reflow composition (e.g., tin lead) deposited onto the terminals 20 and 30 have the same melting temperature as the solder reflow composition into which the substrate ends 162 are dipped. When the melting temperatures are the same or close to the same a solder joint can be made by placing the terminals 20 and 30 in contact with the substrate ends 162 and merely applying heat and, if necessary, flux. Without adding any additional solder, a solder joint is created when the solder reflow composition on the terminals 20 and 30 and on the substrate ends 162 reaches the melting point and is subsequently allowed to cool. Since the contacting points of the terminals 20 and 30 are completely covered with the solder reflow composition, as are the ends 162 of the substrate 80, a better solder joint is formed than would be if external solder material were applied to form the joint.

A fusible conductor 130 in the form of a long continuous wire is connected between the two terminals 20 and 30 to form an electrical current path. The cross-section of the conductor is determined by the particular conductive material used, the normal current that will pass through the fuse 10 and the excess current fusing value desired. The fusible conductor can be a wire, a thick film, a thin film or any other form of conductor common to the industry.

Since a fuse is placed in series with the device to be protected, it is necessary that the fuse carry normal current without spurious failure. Therefore the conductor must be sized to pass the normal current without fusing. Also, the resistance of the particular conductor material must be considered. Conductors having a relatively low resistance can carry more current without fusing than conductors of the same size having a higher resistance. For example, nickel has a higher resistance than copper, therefore if nickel is used as a conductive material, a larger cross section of nickel conductor than copper conductor is necessary to carry the same current.

The conductor 130 is connected between the two terminals 20 and 30 by placing it between the substrate ends 162 and the terminal fingers 70. Due to the solder cladding on the inside of the terminal fingers 70 and the substrate ends 162, the conductor 130 is fastened to terminal fingers 70 and the substrate ends 162 by heating up the contact point and allowing it to cool, thus forming a solder joint by the solder reflow method. This process can also be accomplished without tin or other suitable coatings on the substrate ends 162. The terminals 20 and 30, substrate 80 and conductor 130 form an assembly 60. If the conductor 130 is a fusible wire, strip, etc. the next step is to remove the excess material between the element assemblies.

The FIG. 8 illustrates the assembly 60 after it has been dipped in a ceramic adhesive 180. Other suitable insulating coatings include, but are not limited to, high temperature ceramic coating, stone sand, waterglass or other adhered fillers. The insulating coating absorbs the plasma and decreases the temperature thereof. The ceramic coating coats the fuse assembly 60, thereby making it substantially devoid of air. More importantly, the open channel in the ceramic, which is created by vaporization of the fusible conductor, has a small volume subject to pressurization. Since the open channel is significantly smaller, the pressure therein will be greater, thus resulting in improved fuse performance. The ceramic coating also improves fuse performance by increasing arc resistance through arc cooling.

The ceramic coating 180 also acts to absorb the metal vapor during interruption thus reducing the arc plasma temperature. The solid interior of the insulating coating allows for only a very minute cylindrical chamber or volume to be pressurized. This volume is defined by the volume occupied by the fusible conductor 130 prior to vaporization thereof. Since the gas created by the arc must be contained in such a small area, this results in a much higher local pressure within the arc channel than in an air filled housing. Thus, fast clearing circuit interruption is attained. Additionally, since the ceramic 180 is also in communication with the housing 190, it acts to insulate the plastic housing 190 from the high temperature of the arc. This will eliminate carbonization of the plastic which can result in a restrike of the arc. Since during interruption the temperature inside the fuse housing may rise above 400° F., the ceramic substrate is preferably capable of withstanding about 2000° F.

The ceramic adhesive in the preferred embodiment is made from a mixture of 4–7 parts powder and 1 part water. The ceramic powder used is magnesium oxide and is available from Cotronics Corporation and is known as Cotronics No. 919. This has a resistance of 1000 ohms per centimeter and a dielectric strength of 270 volts per millimeter. The ceramic powder may be sifted with a 50–100 mesh screen prior to mixing with water.

It has been found during the course of preparing the subminiature fuse for mass manufacturing that the ceramic coating 180 will often crack and break away from the substrate 180 during subsequent handling. By causing the ceramic adhesive 180 to penetrate aperture 140 and bond the ceramic adhesive on both faces of assembly 60 the ceramic adheres better to assembly 60. It is believed that the hardened plug of ceramic 180 in aperture 140 acts as a rivet holding the ceramic on both faces of assembly 60 together.

During manufacturing, causing the ceramic adhesive 180 to completely fill the small aperture 140 has been difficult. In the preferred manufacturing method, ceramic may be dispensed on one side of the chip, vibrated through the hole and then dipped. In an alternate manufacturing method after assembly 60 has been dipped in ceramic adhesive 180 it is held in a position horizontal to the ground which allows gravity flow to cause the viscus ceramic adhesive to completely penetrate aperture 140.

Although the above method of insuring complete penetration of aperture 140 by ceramic adhesive 180 has proven the most effective, other methods have also been found to be suitable. For example, ceramic adhesive 180 can be injected directly into aperture 140 by a nozzle or other means prior to dipping assembly 60 in the ceramic adhesive.

Ceramic coated assembly 60 is next coated with a layer of material having a higher dielectric strength. The maximum short circuit capability of a fuse with the single ceramic coating is significantly improved by the addition of this second coating. The single coated fuse appears to fail or rupture when the combination of voltage and current reach a level where the resulting arc is able to penetrate the ceramic coating thereby reaching the plastic housing. This condition appears to prolong arcing resulting in eventual rupture of the body. The second coating, with its superior dielectric strength, acts as a barrier and improves the short circuit capability of the fuse by preventing the arc from reaching the plastic housing.

A material which has been found to be particularly suitable for this second coating application is Boron Nitrate. Other material suitable for this second coating may be selected from a group comprising Boron Silicate, Boron Oxide or any other material with a dielectric strength equal to or greater than Boron Nitrate.

The Boron Nitrate or second coating 200 may be applied in a single layer although it has been found preferable to build up layers of Boron Nitrate by dipping assembly 60 in a solution of Boron Nitrate and allowing each layer to cure prior to the application of the next layer. In the preferred embodiment three or more layers of dielectric material 200 were found to produce the best result. Using one thick layer of dielectric 200 tended to produce cracking when the dielectric was cured.

The assembly 60 is next encased in a one piece housing 190 made from a plastic-like material such as Ryton R-10 available from Phillips Chemical Co. The assembly is placed in a mold and the plastic is forced into the mold in a process known as injection molding at elevated temperature and pressure. A pin is used to position the ceramic coated assembly 60 leaving a hole 110 as shown in FIG. 3. The temperature and pressure and flow rate of injecting the material is critical. Too high a pressure will crack the ceramic adhesive and cause fuse failure. Too high a temperature will cause reflow of the solder and may result in the fuse being open electrically.

The present invention teaches away from the prior molding art in that it uses lower pressure and temperature and flow rate than is specified by the vendor. The pressure is nominally 300 pounds with a nominal temperature of 575° F. and the slowest practical flow rate which will fill the mold. The use of the sealed one piece housing 170 reduces the risk of a catastrophic fuse failure. When the conductor 130 reaches its fusing temperature, it rapidly vaporizes forming a plasma which consists of a gas (usually air) with ions and electrons. At the time the conductor 130 vaporizes an arc is formed between the terminals 20 and 30. Once the arc is established the pressure in the housing 190 increases. This pressure increase in the housing 190 limits the mobility of the charged particles in the plasma. It is important to decrease the charged particles' mobility to decrease the time necessary to extinguish the arc and successfully interrupt the excess current.

It should be apparent that a unique subminiature fuse is disclosed. The fuse and the method for making them are readily adaptable to conventional design practices and automatable manufacturing techniques. Moreover, while the invention is described in conjunction with specific embodiments, it should be apparent that there are alternatives, modifications and variations which will be apparent to those skilled in the art in light of the foregoing description. Accordingly, it is intended to cover all such alternatives, modifications and variations that fall within the spirit and broad scope of the appended claims.

I claim:

1. A subminiature fuse comprising:

(a) two terminals;

(b) substrate, comprised of a material that will not carbonize at high temperature, mechanically linking said two terminals;

(c) a fusible element supported on said substrate and electrically linking said two terminals;

(d) a first coating encasing said fusible element substrate and an upper end of said terminals;

(e) a second coating, having good dielectric strength, at least partially encasing said first coating; and (f) a housing surrounding at least partially encasing said second coating.

2. A subminiature fuse as in claim 1 wherein said substrate has an aperture.

3. A subminiature fuse as in claim 1 wherein said first coating is a ceramic material.

4. A subminiature fuse as in claim 1 wherein said first coating is selected from a group comprised of stone sand, waterglass or other adhesively bound fillers.

5. A subminiature fuse as in claim 1 wherein said second coating is Boron Nitrate.

6. A subminiature fuse as in claim 1 wherein said second coating is selected from a group comprised of Boron Silicate, Boron Oxide or Boron Nitrate.

7. A subminiature fuse as in claim 1 wherein said second coating is built up in layers.

* * * * *